US005895326A

United States Patent [19]

Cozza et al.

[11] Patent Number: 5,895,326

[45] Date of Patent: Apr. 20, 1999

[54] ELECTRONIC GOLF WRIST MOVEMENT TRAINING DEVICE

[76] Inventors: Frank Charles Cozza; Arthur Vincent Harris, both of 4918 N. Harbor Dr., Ste. 104, San Diego, Calif. 92106

[21] Appl. No.: 09/107,162

[22] Filed: Jun. 29, 1998

[51] Int. Cl.[6] ..... A63B 69/36

[52] U.S. Cl. ..... 473/213; 473/276

[58] Field of Search ..... 473/202, 209, 473/213, 276

[56] References Cited

U.S. PATENT DOCUMENTS 3,400,934 9/1968 Muehl ..... 473/213 X 5,827,126 10/1998 Lee ..... 473/276 X

*Primary Examiner*—George J. Marlo

*Attorney, Agent, or Firm*—Frank D. Gilliam

[57] ABSTRACT

A forearm mounted wrist position training device for signaling a golfer when his or her wrists bend improperly during a golf swing. A housing is secured to a forearm with a sensor pad engaging the back of the hand. The pad position can be varied to fit the forearm and wrist position when the golfer addresses the ball. The pad is mounted on one end of a sensor lever with an attachment device attached to the other. An actuator lever is fastened to the attachment device, with the other end pivotally mounted in the housing adjacent to a switch. When the golfer bends his or her wrist beyond a selected limit, the actuator lever will close the switch which will then activate a battery powered circuit to produce a signal such as an audible beep. The training device can be placed on either wrist and is useful with putters and other clubs. The golfer will learn to hold his wrists in the proper position by avoiding causing the signal to sound.

13 Claims, 2 Drawing Sheets

ELECTRONIC GOLF WRIST MOVEMENT TRAINING DEVICE

FIELD OF THE INVENTION

This invention relates in general to golf training devices for providing an audible indication of correct or incorrect movement of the wrists in a golf swing, in particular incorrect wrist bending during swings, chips and putts, and for guiding a golfer towards a consistently correct golf swing.

BACKGROUND OF THE INVENTION

In playing golf, it has long been known that the wrists should hinge in a specific direction parallel to the forearm during the backswing, downswing and until just after the ball is struck. In addition, when putting and chipping, the wrists should remain firm and locked through the back swing and follow through.

When putting and when chipping the ball from near the green, failure to maintain both wrists locked during the backswing and throughout the stroke leads to stubbed putts and misdirection. Putts and chips should be accomplished with a pendulum motion, using the forearms.

When making a full swing during a longer shot, if the wrists hinge in any other direction other than parallel to the forearm during the back swing the player is said to have either opened or closed the club face. This will cause the ball to hook or slice.

A number of different devices have been developed in an attempt to maintain a golfer's hands in the proper golf grip during the golf swing. In U.S. Pat. No. 5,324,038, Sasser describes a device with a sensor mounted on the forearm of the leading arm that has a sensor arm for engaging the back of the hand to signal the direction and degree of any errant hand movement. Osborn, in U.S. Pat. No. 3,508,280 shows a pair of golf gloves which lock together with a tape fastener material. Skouron in U.S. Pat. No. 3,559,212 discloses a single glove with an attachment that holds the last three fingers of the lead hand in place. Washburn in U.S. Pat. No. 4,017,086 describes a complex mechanical device attached to a forearm for holding the wrist in the proper bent or "cocked" position during a swing. position Freyer in U.S. Pat. No. 5,028,050 and Suttle in U.S. Pat. No. 5,184,827 both teach a pair of golf gloves which lock together with hook-and-loop material which produces a tearing sound when separated. Multiple attachments that secure the last two fingers of the gloved lead hand in place are described by Myers in U.S. Pat. No. 5,033,120. While each of these patents attempts to forcibly overcome the grip release or relaxation problem by preventing, at least up to a point, such relaxation or release, none actually teaches the golfer to use his or her natural ability to overcome the problem by maintaining a proper grip and wrist position throughout the golf swing.

Thus, there is a continuing need for improved methods and means for detecting wrist breaking during the different types of golf swings, for signaling proper or improper wrist movement, for teaching a golfer to maintain proper wrist position without rigidly forcing the hands into a particular position throughout a golf swing and which are comfortable and convenient to use.

SUMMARY OF THE INVENTION

The above-noted problems, and others, are overcome in accordance with this invention by a training device attached to a strap configured to be wrapped around one of a person's wrists in a manner similar to a wrist watch, a sensor lever attached to the training device for contacting the back of the person's hand and electrical circuitry in the training device for producing a sound or other signal when the wrist is bent toward the sensor during any type of golf swing. The sensor comprises a sensor lever having a pad at the sensor lever distal tip in contact with the back of the hand. The proximal sensor lever end is pivotally mounted on the distal end of an actuator lever for movement toward and away from the back of the hand. The pivotal mount allows the sensor lever to pivot relative to the sensor lever when the hand is bent toward the sensor lever. As such bending continues, the senor pad will contact the distal end of the actuator lever, causing it to move with the sensor lever as wrist bending continues. A switch in the training device then actuates a switch at a predetermined degree of wrist bending. The switch generates a signal, telling the golfer that his or her wrist has bent and depending on the type of swing (chip, full swing or putt) will signal that the swing was correct or incorrect.

The switch actuates a observable signal, generally an audible tone or beep. If desired, the signal could be a vibration or a slight electrical shock.

The position of the distal tip is adjustable, so that the golfer can adjust it to lie in firm contact with the back of the wrist at the beginning of the swing. Preferably the pivot between sensor lever and actuator lever includes a ratchet like mechanism that will ordinarily maintain a set angle between them, but can be fairly easily overcome to cause the relative pivoting movement.

Any suitable wrist strap could be used, such as a buckled leather strap of the sort used with many wrist watches or a strap using hook-and-loop of the sort available under the Velcro trademark. The hook-and-loop strap is preferred for ease of placing and removing the strap around a forearm near the wrist and the ease of adjusting the tightness of the strap.

BRIEF DESCRIPTION OF THE DRAWING

Details of the invention, and of preferred embodiments thereof, will be further understood upon reference to the drawing, wherein.

DETAILED DESCRIPTION OF PREFERRED EMBODIMENTS

Figures 1, 2:
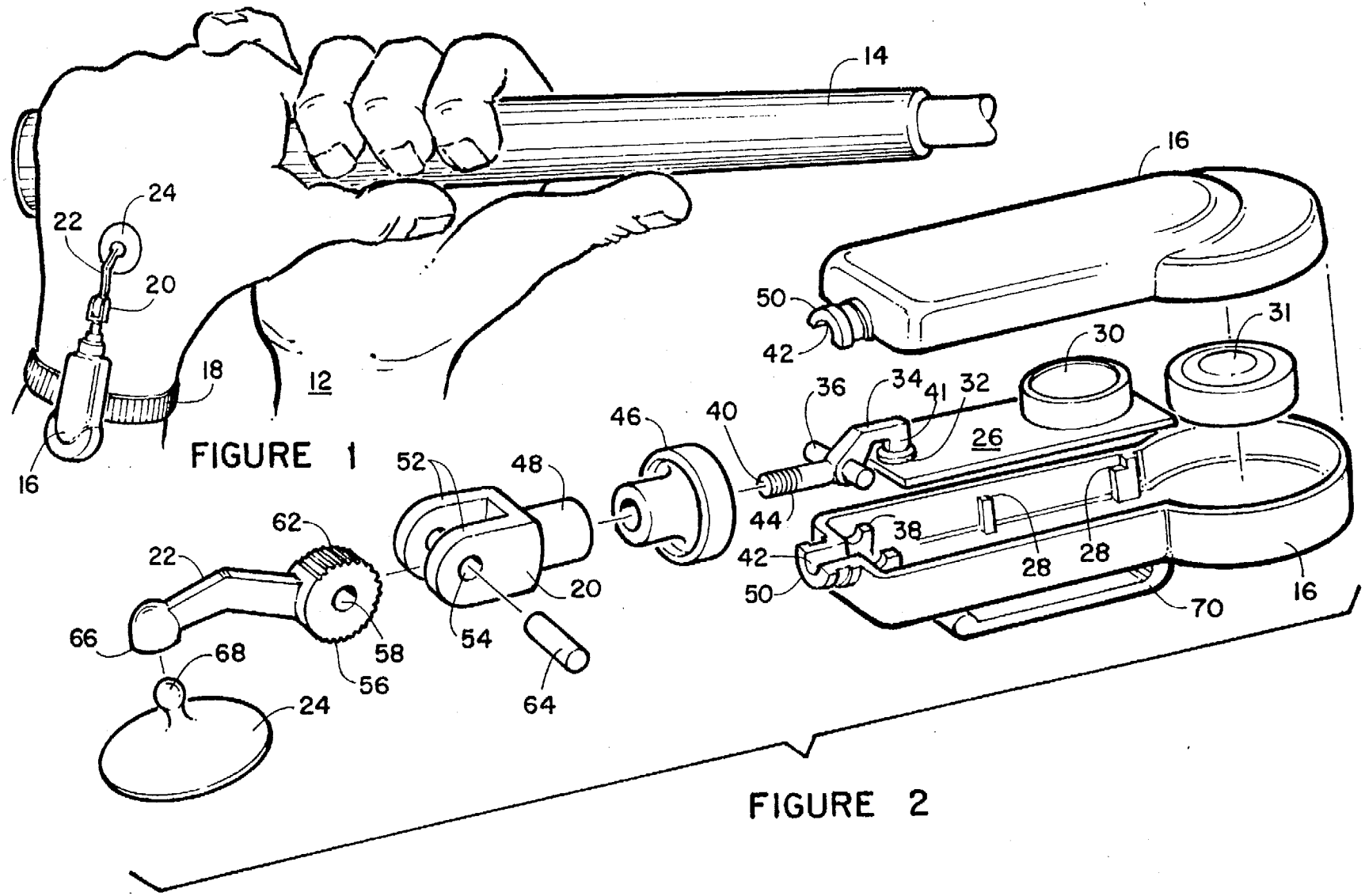
FIG. 1 is a perspective view showing the training device in place on a golfer's wrist.
FIG. 2 is an exploded perspective view of the training device.

Referring to FIG. 1, there is seen the left and right hands 10 and 12 of a right-handed golfer holding a club 14. A housing 16, typically formed from injection molded plastic, is 20 secured the golfer's forearm adjacent to his or her wrist by a band 18, typically a band similar to a leather watch band or a fabric band using a hook-and-loop closure material such as that sold under the Velcro® trademark.

An attachment means 20 and sensor lever 22, as detailed below, extend out of housing 16 across the wrist to the back of either of the golfer's hands, in the embodiment shown the left hand. A pad 24 is pivotally mounted at the distal end of sensor lever 22 for engagement with the back of hand 14. The position of pad 24 is adjustable as detailed below to accommodate different hand and forearm characteristics. Housing 16 may be attached to either the right or left wrist depending on what type of shots the golfer wants to practice, such as full swing, chipping or putting.

The components of the training device are shown in an exploded view in FIG. 2. Housing 16 is formed in two parts, to be secured together in any suitable manner after all components are assembled. Typically, the assembly could be adhesively bonded together if the assembly is sufficiently inexpensive to be thrown away when the battery is exhausted, could have snap-together clips on the halves, could use a screw between the parts, etc. A printed circuit board 26 is supported in housing 16 by molded-in ledges 28 or any other suitable support, such as pins. The ledges and/or pins help the alignment of the printed circuit board 26 and maintain the alignment of dome switch 32. An audible sound generator 30 and battery 32 are secured to printed circuit board 26. Any suitable battery may be used, such as a 3 volt lithium battery, such as a CR-2032 from Sony or Maxwell. Sound generator 30 may typically be an AT-150 from Projects Unlimited. If desired, any other suitable signaling device, such as a vibrator or the sort used in some cellular telephones could be used in place of the sound generator to signal wrist bending.

A conventional dome type switch 32 is mounted on printed circuit board 26. An actuator lever 34 is pivotal about an axle 36 that is pivotally mounted in supports 38. The supports 38 are molded in both top and bottom of housing 16 with a net fit, in order to sandwich axle 36 into the housing for a secure fit. Distal end 40 of actuator lever 34 extends out of opening 42 in housing 16. Proximal end 41 lies adjacent to switch 32, so that raising distal end 40 will cause actuator lever 34 to pivot and press the proximal end against the switch. Attachment means 20 has a hole 44 that fits over distal end 40. Distal end 40 may have a series of circumferential serrations 44 to help hold the distal end in a hole in end 48.

A flexible seal ring 46 has one end sized to fit over the proximal end 48 of attachment means 20 and a second end sized to fit over collar 50 surrounding opening 42 of housing 16 to keep dust, water and the like out of the housing, which could cause a malfunction of the electronics.

The distal end of attachment means 20 has two parallel flanges 52, with a central hole 54 therethrough. Proximal end 56 of sensor lever 22 is configured to fit between flanges 52, with hole 58 corresponding to hole 54 in attachment means 20. Proximal end 56 is generally cylindrical, with attachment means 20 having a corresponding concave cylindrical interior surface 60 between flanges 52.

A pin 64 is sized to fit through holes 54 and 58 to hold proximal end 56 between flanges 52. Preferably, transverse cooperating transverse ridges 62 are provided on both proximal end 56 and surface 60. Proximal lever 22 can be easily manually rotated relative to attachment means to position pad 24 against the back of a hand 10 as seen in FIG. 1, with the transverse ridges increasing friction to hold the sensor arm against rotation absent some force.

The distal end of sensor lever 22 includes a socket 66 to pivotally enclose a ball 68 on pad 24 and allows the pad to uniformly engage the back of a hand.

Figure 3A:
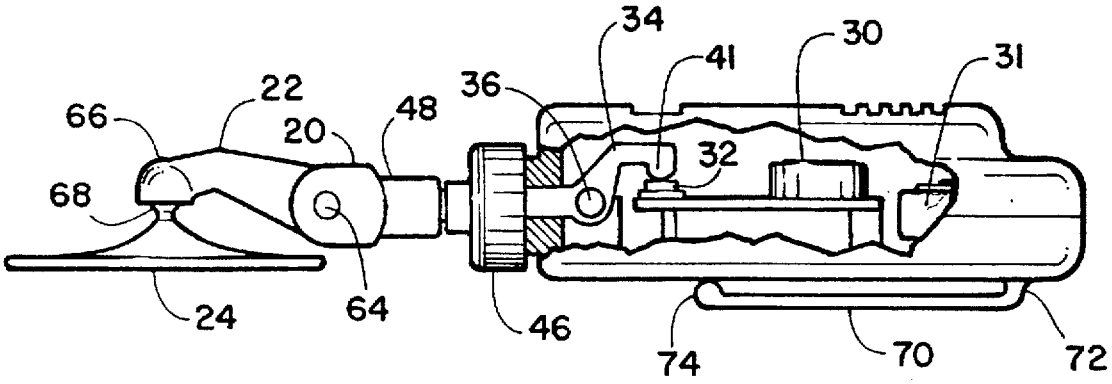
FIG. 3*a* is a side elevation view, partially cut-away, showing the training device in the straight wrist position.
Figure 3B:
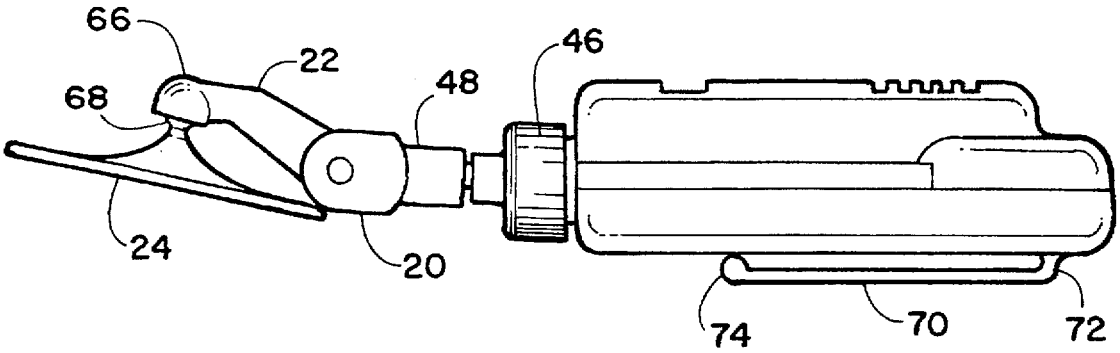
FIG. 3*b* is a side elevation view, partially cut-away, showing the training device in the bent wrist position.
Figure 4:
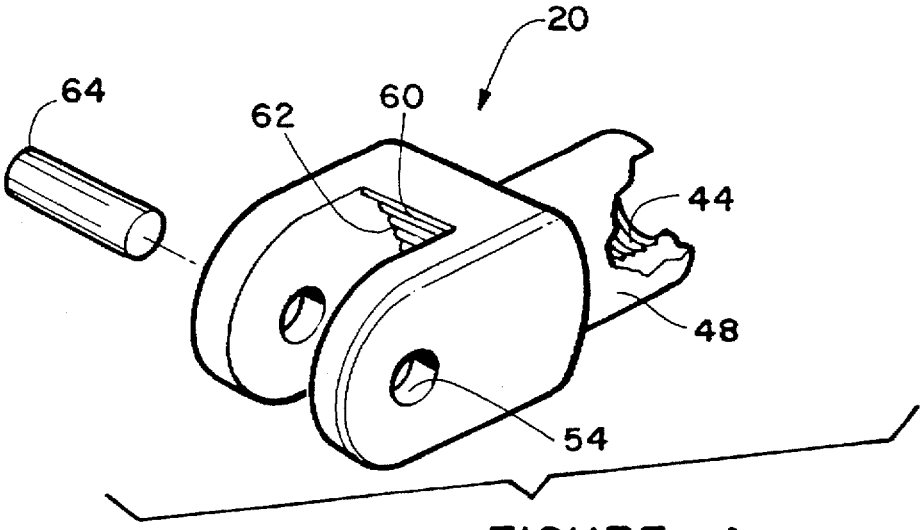
FIG. 4 is a detail perspective view of the attachment means.

FIGS. 3*a* and 3*b* show side elevation views of the complete assembly with FIG. 3*a* showing the assembly in the initial position with pad 24 engaging the hand with the wrist approximately straight and FIG. 3*b* showing the assembly after the wrist is bent beyond the capacity of the pivoting of actuator arm 22 relative to attachment means 20 to accommodate. These Figures show clip 70 that is secured to housing 16 at one end 72 so that the other end 74 can be slipped over a band 18 as seen in FIG. 1.

FIG. 3*a* shows the assembly with sensor lever 22, attachment means 20 and actuator lever 34 in an approximately straight line and proximal end 41 of actuator lever 34 is just out of contact with switch 32. If the wrist is bent only slightly, pad 24 will be pushed upwardly, causing sensor lever 22 to pivot against the slight retaining force of cooperating transverse ridges 62. As seen in FIG. 3*b*, once pad 24 has moved upwardly until the edge of the pad contacts flanges 52 of attachment means 20, with the pad flat against the back of the golfer's hand, further rotation of sensor lever 22 relative to attachment means 20 is no longer possible. This locks those components together and with actuator lever 34 so that now the actuator lever must begin to pivot about axle 36, bringing proximal end 41 into pressure contact with switch 32 that then snaps to the closed position, activating horn 30 to indicate excessive wrist bending.

If the wrist is straightened, pressure on switch 32 will be released, the switch will snap back to the open position and the signal will stop. Cooperating transverse ridges between sensor arm 22 and attachment means 20 will hold the sensor arm in the limit position until the user readjusts the arm to bring pad 24 back into contact with the hand. While certain specific relationships, materials and other parameters have been detailed in the above description of preferred embodiments, those can be varied, where suitable, with similar results. Other applications, variation and ramifications of the present invention will occur to those skilled in the art upon reading the present disclosure. Those are intended to be included within the scope of this invention as defined in the appended claims.

I claim:

1. A wrist position training device for golfers which comprises:

a housing;

means for releasably securing said housing to a golfer's forearm adjacent to a wrist;

a sensor lever for extending along said wrist to a golfers hand;

a pad pivotally mounted on a distal end of said sensor lever for engagement with said golfer's hand;

attachment means secured to a proximal end of said sensor lever for allowing movement of said sensor lever with said golfer's hand relative to said attachment means as said wrist is bent toward said sensor lever;

an actuator lever pivotally mounted in said housing and having a distal end secured to said attachment means;

a normally open switch means positioned adjacent to an actuator lever proximal end for actuation by said actuator lever; and alarm means for producing a signal perceivable by said golfer when said switch is closed as said wrist is bent toward said sensor lever a predetermined distance.

2. The wrist position training device according to claim 1 wherein said pad is sized so that an edge of said pad will engage and move said attachment means to pivot said actuator lever when said wrist is bent toward said sensor lever said predetermined distance to cause said actuator lever proximal end to engage and close said switch.

3. The wrist position training device according to claim 1 wherein said means for releasably securing said housing to a golfer's forearm comprises a band fastenably around said forearm and a clip on said housing for engaging said band.

4. The wrist position training device according to claim 3 wherein said band comprises hook-and-loop material for fastening said band around said forearm and said clip has an open end for slipping around said band while said band is on said forearm.

5. The wrist position training device according to claim 1 wherein said means for producing a perceivable signal comprises means for generating at least one audible beep.

6. The wrist position training device according to claim 1 wherein said attachment means and sensor lever have cooperating ridges on contacting surfaces so that said contacting surfaces will releasably hold said sensor lever in position relative to said attachment means until released by imposition of a predetermined force.

7. The wrist position training device according to claim 1 further including an elastic boot between said attachment means and said housing.

8. The wrist position training device according to claim 1 wherein said pad is mounted on said distal end of said sensor lever by a ball and socket connection allowing tilting of said pad in all directions over a predetermined range of motion.

9. A wrist position training device for golfers which comprises:

a housing;

means for releasably securing said housing to a golfer's forearm adjacent to a wrist;

a sensor lever for extending along said wrist to a golfers hand;

a pad pivotally mounted on a distal end of said sensor lever for engagement with said golfer's hand;

attachment means secured to a proximal end of said sensor lever for allowing movement of said sensor lever with said golfer's hand relative to said attachment means as said wrist is bent toward said sensor lever;

a plurality of transverse ridges on contacting surfaces of said attachment means and said sensor lever for releasably holding the relative position of said contacting surfaces until subjected to a predetermined moving force;

an actuator lever pivotally mounted in said housing and having a distal end secured to said attachment means;

a normally open switch means positioned adjacent to an actuator lever proximal end for actuation by said actuator lever;

said pad being sized so that an edge of said pad will engage and move said attachment means to pivot said actuator lever when said wrist is bent toward said sensor lever said predetermined distance to cause said actuator lever proximal end to engage and close said switch; and alarm means for producing an audible signal perceivable by said golfer when said switch is closed as said wrist is bent toward said sensor lever a predetermined distance.

10. The wrist position training device according to claim 9 wherein said means for releasably securing said housing to a golfer's forearm comprises a band fastenably around said forearm and a clip on said housing for engaging said band.

11. The wrist position training device according to claim 10 wherein said band comprises hook-and-loop material for fastening said band around said forearm and said clip has an open end for slipping around said band while said band is on said forearm.

12. The wrist position training device according to claim 9 further including an elastic boot between said attachment means and said housing.

13. The wrist position training device according to claim 9 wherein said pad is mounted on said distal end of said sensor lever by a ball and socket connection allowing tilting of said pad in all directions over a predetermined range of motion.

* * * * *